US005255002A

United States Patent [19]

Day

[11] Patent Number: 5,255,002

[45] Date of Patent: Oct. 19, 1993

[54] ANTENNA FOR VEHICLE WINDOW

[75] Inventor: Stephen R. Day, Wigan, United Kingdom

[73] Assignee: Pilkington plc, St. Helens, United Kingdom

[21] Appl. No.: 834,355

[22] Filed: Feb. 12, 1992

[30] Foreign Application Priority Data

Feb. 22, 1991 [GB] United Kingdom ..... 9103737

[51] Int. Cl.[5] ..... H01Q 1/32

[52] U.S. Cl. ..... 343/713; 343/848

[58] Field of Search ..... 343/711-713, 343/846-848

[56] References Cited

FOREIGN PATENT DOCUMENTS

| | | | |
|---|---|---|---|
| 2336320 | 2/1975 | Fed. Rep. of Germany | 343/713 |
| 3738226 | 5/1989 | Fed. Rep. of Germany . | |
| 0353378 | 2/1990 | Fed. Rep. of Germany . | |
| 62-081101 | 4/1987 | Japan . | |
| 2180695 | 4/1987 | United Kingdom . | |

*Primary Examiner*—Michael C. Wimer

*Attorney, Agent, or Firm*—Burns, Doane, Swecker & Mathis

[57] ABSTRACT

This invention concerns an antenna system for the transmission and reception of radio waves for, typically, cellular radio communication. The antenna is, ideally, formed on a vehicle window and is so designed to enable minimum obstruction to viewing through the window and to provide excellent electrical impedance matching between the antenna and connecting coaxial cable. Several embodiments are disclosed, however, the essential design comprises two closely located conducting members to which electrical connection is made, located on the window. The first conducting member is "V"-shaped with each leg of the "V" being equivalent in length to $\lambda/4$. The angle between the two arms of the "V" are carefully selected as is the angle between the arms and the edge of the window. The apex of the "V" points towards the edge of the window and an intervening second electrical conductor which is parallel to the edte of the window. Electrical connection is made to the two conductors at points at the apex of the "V" on the first conductor and immediately opposite the apex of the "V" on the second conductor. The second conductor projects $\frac{1}{4}+n/2$ wavelengths each side of the connection point, where n is a positive integer (including zero).

10 Claims, 5 Drawing Sheets

ANTENNA FOR VEHICLE WINDOW

The invention relates to an antenna formed on a vehicle window for transmission and/or reception of radio waves particularly, but not exclusively, for a mobile telephone.

BACKGROUND OF THE INVENTION

It is known to print antennae of various forms onto vehicle windows as they have advantages in not being exposed to external damage.

Cellular radio communication is now widely used for mobile telephones in vehicles and it is an object of the present invention to provide an improved antenna on a vehicle window suitable for use with such a mobile vehicle phone.

A conventional rod aerial externally mounted on a vehicle has two terminals normally connected to a coaxial cable the outer conductor of which provides an earth connection coupled to the vehicle body where the antenna is mounted.

It is a further object of the present invention to provide an antenna on a vehicle window with an improved matching connection to a coaxial cable.

SUMMARY OF THE INVENTION

The present invention provides a vehicle window comprising a sheet for mounting on a vehicle body, said sheet supporting thereon adjacent an edge of the sheet an antenna system for transmission and/or reception of radio waves said antenna system comprising (a) a first conducting member having lateral edges inclined inwardly towards each other to form an apex pointing towards said edge of the sheet and a connection terminal at a position on the first conducting member towards said edge, and (b) a second conducting member electrically insulated from the first conducting member and having a respective connection terminal, said second conducting member being located between the first conducting member and said edge, both said conducting members lying in the plane of said sheet.

Preferably said second conducting member is arranged to form a transmission line with said vehicle body when in situ and thereby form an earth line for the antenna system.

Preferably said first conducting member includes a substantially V-shaped member having the connection terminal at the apex of the V.

Preferably said second conducting member comprises a linear conductor extending substantially parallel to said edge of the sheet.

Preferably said first conducting member has a central axis of symmetry extending substantially perpendicular to said edge of the sheet.

Preferably in situ said second conducting member extends substantially horizontally and said axis of symmetry of the first conducting member extends substantially vertically.

Preferably the angle between said inclined lateral edges is less than 140°, and preferably between 40° and 110°.

Preferably each said inclined lateral edge has a length substantially equal to $\frac{1}{4}\lambda$ where $\lambda$ is the wave length of the radio wave to be transmitted and received.

Preferably said second conducting member comprises a linear conductor having a length of $(\frac{1}{4}+n/2)\lambda$, where n is an integer, on one or both sides of said connection terminal of the second conducting member. n may have a different integer value on the two sides of the connection terminal.

DESCRIPTION OF THE PREFERRED EMBODIMENTS

Figure 1:
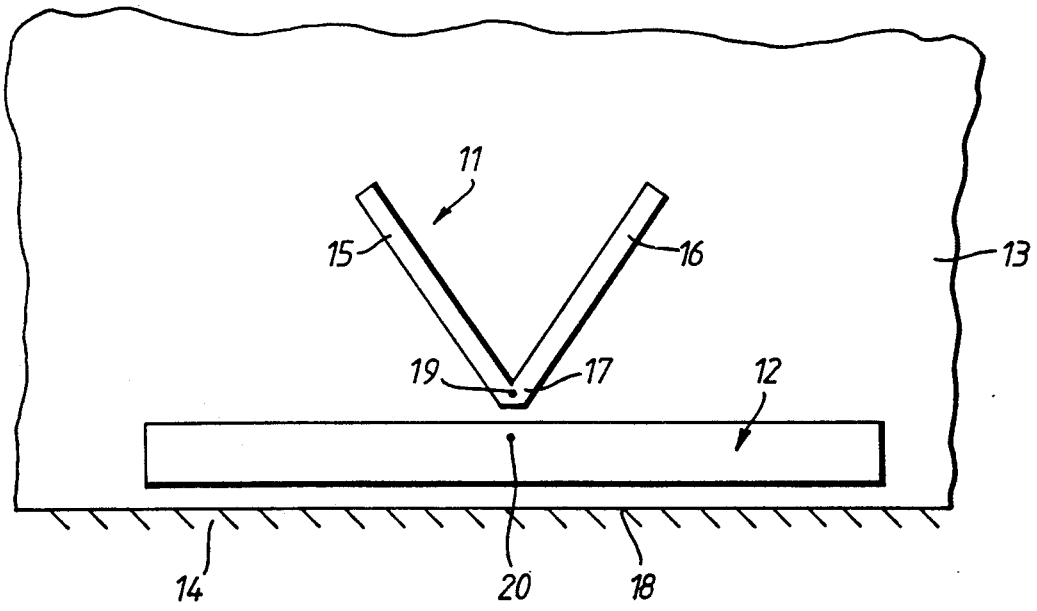
FIG. 1 shows one design of antenna on a vehicle windscreen providing a preferred embodiment of the invention.

Each of these examples provides an antenna suitable for use with a cellular radio phone, the antenna comprising first and second conducting members 11 and 12 supported on a transparent glass sheet 13 for mounting on a vehicle body 14. The antenna may be printed or otherwise formed on the glass sheet so that the conducting members 11 and 12 lie effectively in the plane of the sheet which may be flat or curved. The conducting members may be applied to an inner surface of glass in a laminate window or alternatively and more usually they may be formed on an external glass surface of a laminate or a monolith sheet. They may also be covered by an electrically insulating sheet such as a plastic film which may be transparent or opaque. Alternatively a non-conductive substance may be printed or painted over otherwise accessible parts of the conducting members.

In each example, the first conducting member 11 has lateral edges 15 and 16 which are inclined inwardly towards each other to form an apex 17 pointing towards an edge 18 of the sheet 13. A first connection terminal 19 is provided on the first conducting member at a position towards the edge 18 of the sheet 13. The second conducting member 12 is electrically insulated from the first conducting member 11 and has a connection terminal 20. The second conducting member 12 is located between the first conducting member 11 and the edge 18 of the glass sheet 13.

In the example shown in FIG. 1 the first conducting member 11 is V-shaped so that the lateral edges 15 and 16 are provided by two inclined arms of the V. The conductor may be formed from wire or conductive tracks which each have a width of typically 2 mm. The length of the two arms 15 and 16 are each one quarter the wavelength of the radio waves used in the cellular system. The V has a central axis of symmetry between the two arms 15 and 16, the axis of symmetry being perpendicular to the edge 18 of the sheet 13 and vertical when in situ in a vehicle body. The angle between the two arms 15 and 16 is preferably less than 140° and more preferably between 40° and 110°. 90° provides a particularly effective embodiment. In the arrangement shown in FIG. 1, the second conducting member 12 comprises a straight linear track of conducting material having a width between 5 and 20 mm. It is printed on the glass close to and parallel to the edge 18 of the glass sheet. This track may be hidden behind a fade-in band on the glass. In use the track 12 extends horizontally and is symmetrically located relative to the apex 17 of the V-shaped conductor. In this way a connection terminal 20 is centrally provided on the track 12 so that the connector 20 is close to but electrically insulated from the connection terminal 19 on the V conductor. The track 12 extends equally on both sides of the connection terminal 20 and the length of projection of each half of the track 12 is $(\frac{1}{4}+n/2)\lambda$ where $\lambda$ is the wavelength of the radio waves used and n is an integer. Although in this example the track extends symmetrically on either side of the apex of the V-shaped conductor the track 12 may be arranged to extend on one side only or unequally on both sides provided the extension on each side meets the requirement of being $(\frac{1}{4}+n/2)\lambda$. The angle between each of the arms 15 and 16 and the horizontal track 12 may be adjusted to suit the particular application and is usually greater than 20° and preferably between 35° and 70°. 60° is a particularly good example. As this angle is increased the greatest bandwidth is obtained at a progressively increasing impedance. The angle chosen at any specific location on a vehicle will be such as to obtain the best bandwidth to, typically 50 , coaxial cable. In the particular example shown in FIG. 1, the track 12 may be 100 mm in length or 300 mm in length so that the system is particularly useful for a 900 MHz cell phone frequency. The track 12 is spaced a short distance from the edge 18 of the glass sheet and acts as an electrical transmission line between itself and the adjacent metal bodywork of the vehicle. In use the outer braid of a coaxial cable is connected to the connection terminal 20 and the inner line of the coaxial cable is connected to the connection terminal 19. In this way the transmission line formed by the track 12 acts as an open circuit at its outer ends and thereby forms an effective short circuit between the track 12 and the adjacent vehicle bodywork 14 adjacent the connection terminal 20. This has the same effect as connecting the outer braid of the coaxial cable to the bodywork 14 and thereby providing an earth part.

The coaxial cable used with the example of FIG. 1 is 50 ohm cable and this embodiment provides an improved matching of the antenna impedance with the coaxial cable impedance over a broader band width than usual. This improved broad band width performance obtained by the example of FIG. 1 is relatively insensitive to the cable routing and positioning due to the effective short circuit provided between the connection point 20 and the car bodywork 14.

It will be appreciated that the dimensions referred to above in terms of the wavelength of radio waves used do of course relate to the velocity of the radio waves in the media around the antenna section and in the case of 900 MHz communications the length of a quarter wave using printed and adhesive copper tape implementations on a glass windscreen has been found to be around 45–55 mm.

The coaxial cable may be connected to the connection terminals 19 and 20 by splitting the cable core and braid close to the connection points or alternatively suitable connecting devices may be mounted on the glass so that the connector devices are coupled to the terminals 19 and 20. Such connectors may be secured to the glass by adhesive and electrical connections with the terminals 19, 20 and coaxial cable may be formed by soldering or spring-loaded connections.

Other shapes of first and second conducting members forming an antenna in accordance with the invention are shown in FIGS. 4 to 11. Each of these examples includes a first conducting member 11 having the inclined lateral edges referred to above as well as a second conducting member 12 located between the first conducting member and the car body. Like reference numerals have been used for parts corresponding to those of FIG. 1.

Figure 8:
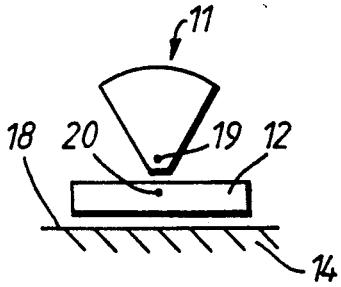
Figure 9:
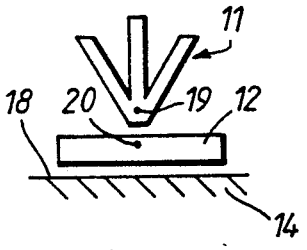
Figure 10:
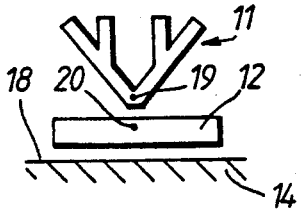
Figure 11:
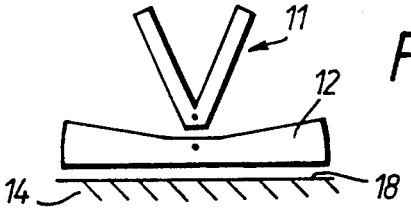
Figure 12:
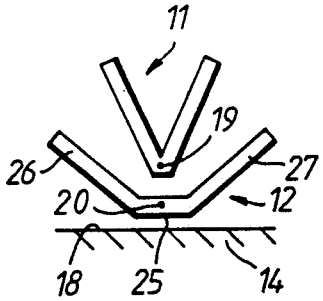

It will be seen that in FIGS. 4, 5, 6, 7, 9 and 10 the V-shaped conducting member has added vertical or horizontal arms. In the case of FIG. 8 the inclined lateral edges of the conductor are formed by a segment of a circular conducting member. In the case of FIG. 11 the track 12 is an extended track parallel to the edge 18 of the window but the upper edges of the track are inclined so that the track is outwardly flared on moving away from the centre connection terminal 20. In the case of FIG. 12 the second conducting member 12 has a short horizontal middle section 25 and upwardly inclined outer sections 26 and 27.

Figure 13:
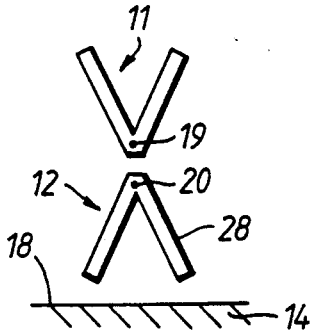

In the case of FIG. 13 the second conducting member is in the form of a second V-shaped member 28. The second V-shaped member is located between the first conducting member and the edge 18 having its axis of symmetry aligned vertically with that of the first conducting member 11. The two apexes are arranged face to face but electrically insulated from each other, each having respective connection terminals 19 and 20. This embodiment extends further into the glass window 13 than those embodiments having a linear track 12.

It will be appreciated that the above described examples can be arranged close to the lateral edge of a vehicle window so as to project only slightly into areas which are normally reserved for vision.

The invention is not limited to the details of the foregoing examples.

It will be seen that in the above examples the connection terminal 19 is provided on the first conducting member at a position nearest the edge 18 of the sheet 13 so that the first conducting member extends away from the terminal 19 in a direction away from the edge 18.

Figure 2:
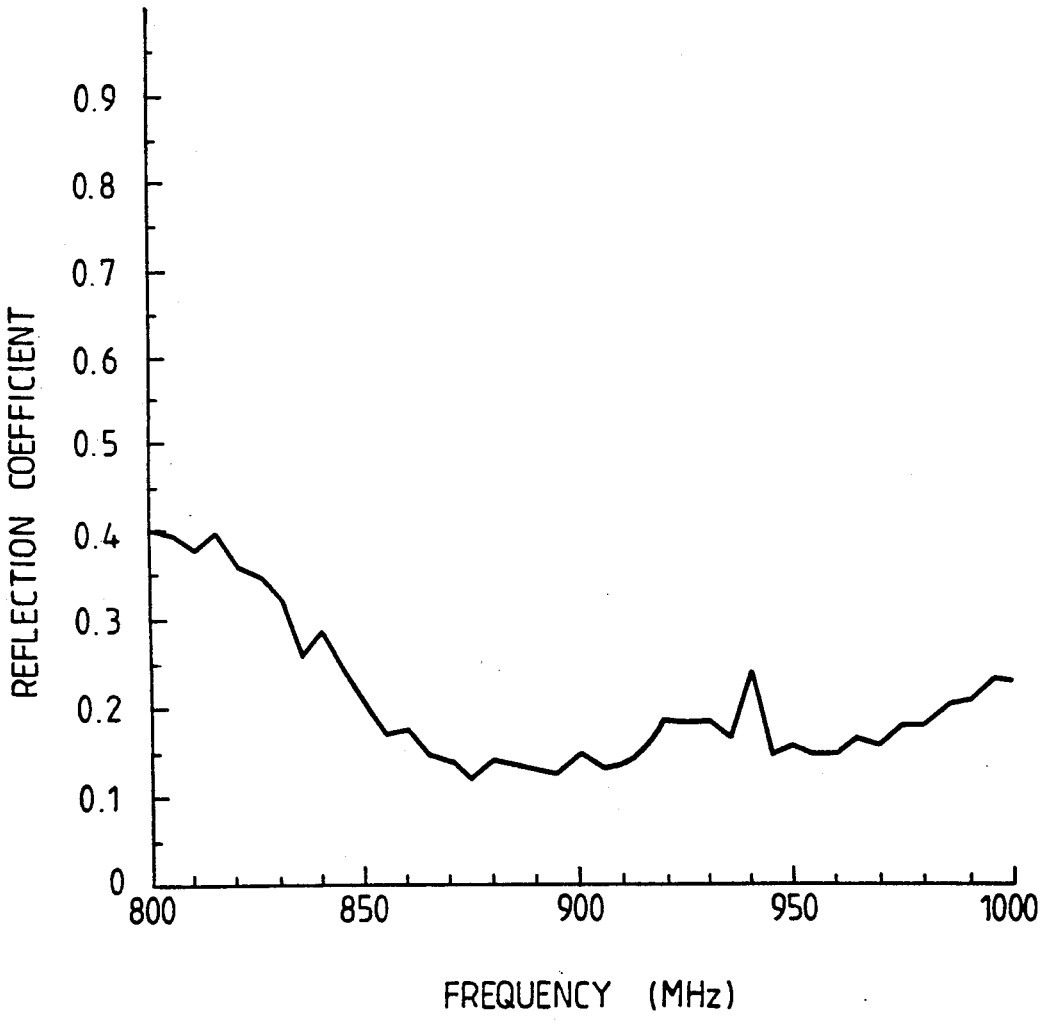
FIGS. 2 and 3 show impedance matching results on connecting an antenna of the type shown in FIG. 1 to a coaxial cable in different positions in a vehicle.
Figure 3:
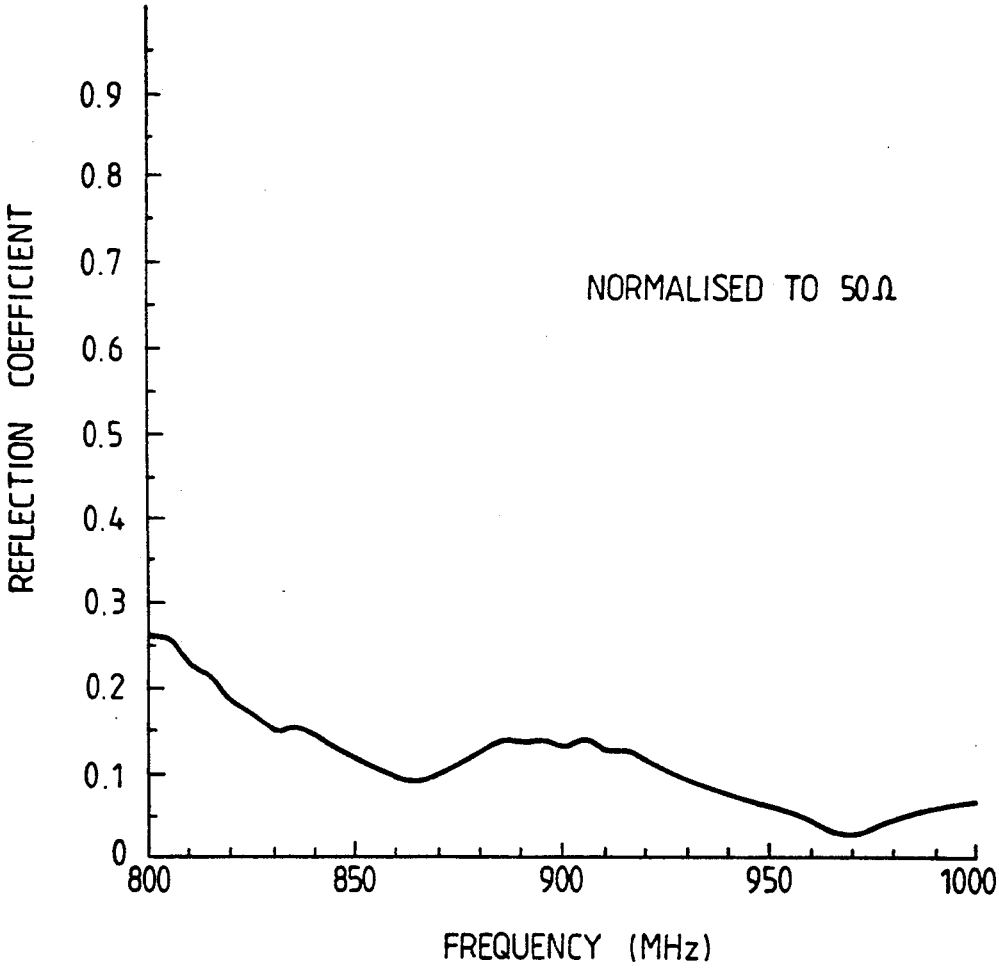
Figure 4:
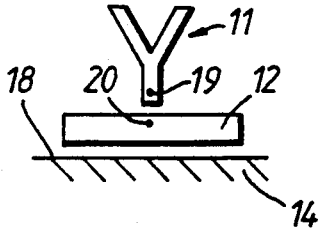
FIGS. 4 to 13 show different embodiments of an antenna in accordance with the present invention.
Figure 5:
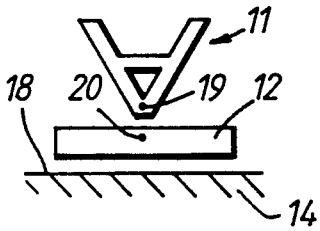
Figure 6:
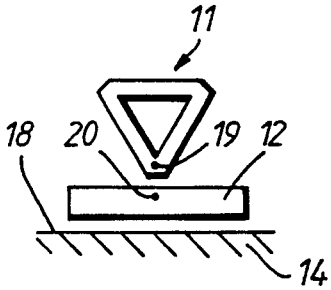
Figure 7:
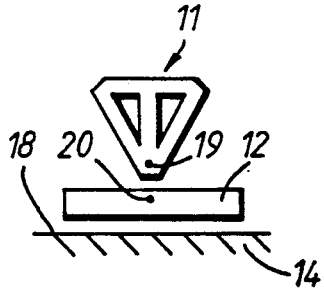

The reflection coefficient for two antennae of the type shown in FIG. 1 in different positions in a vehicle window are shown in FIGS. 2 and 3. In each case the reflection coefficient is shown for a range of frequencies and it can be seen that the reflection coefficient is reduced showing improved matching with the connecting cable over a broad bandwidth, such as 850 MHz to 980 MHz, relevant to the cellular radio system used for a vehicle telephone.

The antenna may be formed in any window such as a windscreen, backlite, sidelite, quarterlite, sixthlite or rooflite of a vehicle. The antenna may alternatively be used for reception of radio signals other than mobile telephones, such as television signals.

I claim:

1. A vehicle window comprising a sheet for mounting on a vehicle body, said sheet supporting thereon adjacent an edge of the sheet an antenna system for transmission and/or reception of radio waves, said antenna system comprising (a) a first conducting member in the form of a single V-shaped member having lateral edges each of a length substantially equal to $\frac{1}{4}\lambda$ where $\lambda$ is the wave length of the radio wave to be transmitted and received, said lateral edges being inclined inwardly towards each other to form an apex pointing towards said edge of the sheet and a connection terminal at the apex of said first conducting member, and (b) a second conducting member electrically insulated form the first conducting member and having a respective connection terminal, said second conducting member comprising a linear conductor having a length of substantially $(\frac{1}{4}+n/2)\lambda$ where n is an integer, on at least one side of said connection terminal of the second conducting member and being located between the first conducting member and said edge so as to form a transmission line with said vehicle body when located in said vehicle body and thereby form an earth line for the antenna system, both said conducting members lying in the plane of said sheet.

2. A vehicle window according to claim 1 in which said second conducting member extends substantially parallel to said edge of the sheet.

3. A vehicle window according to claim 1 in which said first conducting member has a central axis between said lateral edges extending substantially perpendicular to said edge of the sheet.

4. A vehicle window according to claim 3 in which the arrangement is such that when the window is located in said vehicle body said second conducting member extends substantially horizontally and said central axis of the first conducting member extends substantially vertically.

5. A vehicle window according to claim 1 in which the angle between said inclined lateral edges is less than 140°.

6. A vehicle window according to claim 5 in which said angle is between 40° and 110°.

7. A vehicle window according to claim 1 in which the second conducting member extends equally on opposite sides of the connecting terminal of the second conducting member and the apex of the first conducting member is located adjacent the center of the second conducting member.

8. A vehicle window according to claim 1 in which the antenna system is arranged to transmit and/or receive radio waves in the range of 850 to 980 MHz.

9. A vehicle window according to claim 1 in which a 50 ohm coaxial cable is connected to respective connection terminals of the antenna system.

10. A vehicle window according to claim 1 in which said antenna system is formed on a transparent sheet below a transparent insulating layer.

* * * * *